US005576685A

United States Patent [19]

Saito

[11] Patent Number: 5,576,685

[45] Date of Patent: Nov. 19, 1996

[54] SOUND GENERATION APPARATUS RESPONSIVE TO ENVIRONMENTAL CONDITIONS FOR USE IN A PUBLIC SPACE

[75] Inventor: Tsutomu Saito, Iwata, Japan

[73] Assignee: Kabushiki Kaisha Kawai Gakki Seisakusho, Shizuoka-ken, Japan

[21] Appl. No.: 336,695

[22] Filed: Nov. 7, 1994

Related U.S. Application Data

[63] Continuation of Ser. No. 998,868, Dec. 30, 1992, abandoned.

[30] Foreign Application Priority Data

Jan. 29, 1992 [JP] Japan ..... 4-054506

[51] Int. Cl.[6] ..... G08B 3/00

[52] U.S. Cl. ..... 340/384.1; 84/663; 340/328; 340/384.3; 340/384.7; 381/82

[58] Field of Search ..... 340/825.25, 286.11, 340/309.15, 384.1, 384.3, 384.5, 384.7, 692, 474.460, 384.72, 384.71, 584, 585, 602, 328; 84/663, 665, 662, 600, 601, 602, 464 R; 381/58, 61, 82, 57

[56] References Cited

U.S. PATENT DOCUMENTS

| | | | |
|---|---|---|---|
| 4,052,720 | 10/1977 | McGregor et al. | 340/692 |
| 4,352,089 | 9/1982 | Yano et al. | 340/460 |
| 4,472,069 | 9/1984 | Yamamoto | 340/384 E |
| 4,594,573 | 6/1986 | Yoshino et al. | 340/384 E |
| 4,704,931 | 11/1987 | Nagai et al. | 84/600 |
| 4,816,809 | 3/1989 | Kim | 340/584 |
| 4,966,051 | 10/1990 | Tajima | 84/663 |
| 5,081,896 | 1/1992 | Hiyoshi et al. | 84/600 |
| 5,130,693 | 7/1992 | Gigandet | 340/384 E |

FOREIGN PATENT DOCUMENTS

| | | | |
|---|---|---|---|
| 0240591 | 10/1987 | European Pat. Off. | 84/464 R |
| 2126296 | 5/1990 | Japan . | |
| 3126996 | 5/1991 | Japan . | |

*Primary Examiner*—Brent A. Swarthout

[57] ABSTRACT

A sound generation device used in a public space generates tone data corresponding to a change in environment such as environmental noise, temperature, brightness, and the like. The sound generation device includes a detector for detecting environmental noise, temperature, brightness, and the like, and forms tone control data on the basis of the detected environment information. Tone parameters to be supplied to a tone generation LSI or a sound effect DSP are controlled according to the tone control data, thereby selecting and controlling a play No. of tone sources, tone color, tone volume, tempo, reverberation, and the like of tones or music tones to be generated.

51 Claims, 14 Drawing Sheets

FIG. 2

| TIME\CONT INFO | BASIC PATTERN | NOISE LEVEL | TEMP/HMD | BRIGHTNESS | |
|---|---|---|---|---|---|
| 0 a.m. | OFF | – | – | – | LIGHT-ON |
| 1 | OFF | – | – | – | LIGHT-ON |
| 2 | OFF | – | – | – | LIGHT-ON |
| 3 | OFF | – | – | – | LIGHT-ON |
| 4 | (cock-adoodle-doo) | TIME CONT | TONE CLR CONT | TIME CONT | LIGHT CONT |
| 5 | CHIRP SND | VOL/REVERB.CONT | CHNG PLAY NO./TEMPO CONT | PITCH CONT | LIGHT CONT |
| 6 | PLAY NO.1 | VOL/REVERB.CONT | CHNG PLAY NO./TEMPO CONT | PITCH CONT | LIGHT-OFF |
| 7 | PLAY NO.2 | | | | |
| 8 | PLAY NO.3 | | | | |
| 9 | PLAY NO.4 | | | | |
| 10 | PLAY NO.5 | | | | |
| 11 | PLAY NO.6 | | | | |
| 12 p.m. | PLAY NO.7 | | | | |
| 13 | PLAY NO.8 | | | | |
| 14 | PLAY NO.9 | | | | |
| 15 | PLAY NO.10 | | | | |
| 16 | PLAY NO.11 | | | | |
| 17 | PLAY NO.12 | | | | |
| 18 | CAW SND | TIME CONT | TONE CLR CONT | TIME CONT | LIGHT CONT |
| 19 | (hoot) | TIME CONT | TONE CLR CONT | TIME CONT | LIGHT CONT |
| 20 | OFF | – | – | – | LIGHT-ON |
| 21 | OFF | – | – | – | LIGHT-ON |
| 22 | OFF | – | – | – | LIGHT-ON |
| 23 | OFF | – | – | – | LIGHT-ON |

FIG. 12

| | | | |
|---|---|---|---|
| STEP TIME<br>KEY-ON INFO<br>KEY CODE<br>ON-VELOCITY | STEP TIME<br>KEY-OFF INFO<br>KEY CODE<br>OFF-VELOCITY | STEP TIME<br>TONE CLR INFO<br>TONE CLR CODE<br>(NOT USED) | STEP TIME<br>TEMPO INFO<br>TEMPO SPEED<br>(NOT USED) |
| STEP TIME<br>VOLUME INFO<br>VOLUME CODE<br>(NOT USED) | STEP TIME<br>REVERB.INFO<br>REVERB.INFO<br>(NOT USED) | STEP TIME<br>BAR INFO<br>BAR CODE<br>BEAT CODE | STEP TIME<br>END INFO<br>(NOT USED)<br>(NOT USED) |

FIG. 13

| | |
|---|---|
| PNT+0 | TEMPO SPEED |
| +1 | TONE CLR CODE |
| +2 | VOLUME CODE |
| +3 | REVERB.CODE |

SOUND GENERATION APPARATUS RESPONSIVE TO ENVIRONMENTAL CONDITIONS FOR USE IN A PUBLIC SPACE

This application is a continuation, of application Ser. No. 07/998,868 filed on Dec. 30, 1992, now abandoned.

BACKGROUND OF THE INVENTION

1. Field of the Invention

The present invention relates to a sound generation apparatus arranged at a park, crossing, or the like and, more particularly, to a sound generation apparatus which controls the tone volume, tone color (including a natural tone), play No. of tone sources, play tempo, and the like of tones to be generated in correspondence with environmental conditions such as the noise level, humidity, temperature, brightness, and the like, and at the same time, performs lighting control by utilizing the environment information and time information.

2. Description of the Related Art

Conventional sound generation apparatuses in public facilities assume a mission of public announcement. For example, an apparatus of this type plays different music pieces in correspondence with, e.g., a traffic signal (red or green signal) at a crossing, and a pedestrian can know the "red" or "green" signal without watching the signal. Some sound generation facilities equipped in schools or parks periodically perform auto-play operations.

However, such a sound generation facility plays a predetermined music piece with a predetermined tempo, tone volume, and tone color. When a person listens to such a repetitive play, it becomes painful for him or her to listen to it. Such pain is caused by too large a tone volume, a tone color excessively far from a natural tone, an excessively digital play method, and so on.

A "monotonous repetitive play" has both merits and demerits, and its effect is undoubted. However, it is painful for a person to have to listen to a monotonous repetitive play which is made regardless of the environmental conditions at that time.

The effect obtained by reducing monotonousness by adopting randomness (e.g., fluctuation) in a play is also limited.

SUMMARY OF THE INVENTION

It is an object of the present invention to get rid of stress experienced by people when a sound generation apparatus in a public facility always plays a predetermined music piece with a predetermined tempo, tone volume, and tone color.

A sound generation apparatus according to the present invention receives environment information (noise level, humidity, temperature, brightness, and the like) of a place where it is installed, and controls generation of tones with a tone color (including a natural tone), tone volume, tone pitch, play No. of tone sources, and tone generation speed (play tempo) matching with the environment information. The apparatus also performs lighting control by utilizing the environment information and time information.

An environment information input device inputs a plurality of pieces of noise information, temperature•humidity information, and a plurality of pieces of brightness information. The plurality of noise information and brightness information each having a plurality of inputs are respectively grouped into one information. A controller periodically receives the environment information, and obtains various control data (play No. control data, tone color control data, tone volume control data, tempo control data, reverberation control data, and the like) by looking up various condition tables (or formulas) stored in an external storage unit on the basis of these pieces of information. The controller controls various parameters of a tone generation LSI and a sound effect DSP on the basis of the control data, samples and holds D/A-converted data, and then produces tones from a plurality of loudspeakers.

The play number (assigned to a stored tone sequence), tone volume, tone pitch, tempo, reverberation, and the like of the tones generated from the loudspeakers are controlled on the basis of the noise information, temperature•humidity information, brightness information, and the like, and the generated tones are gentle to persons who listen to them. The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 2 is a table showing control contents based on environment information;

FIG. 12 shows the format of music data;

FIG. 13 shows the format of a header portion of music data;

DETAILED DESCRIPTION OF THE PREFERRED EMBODIMENT

Figure 1:
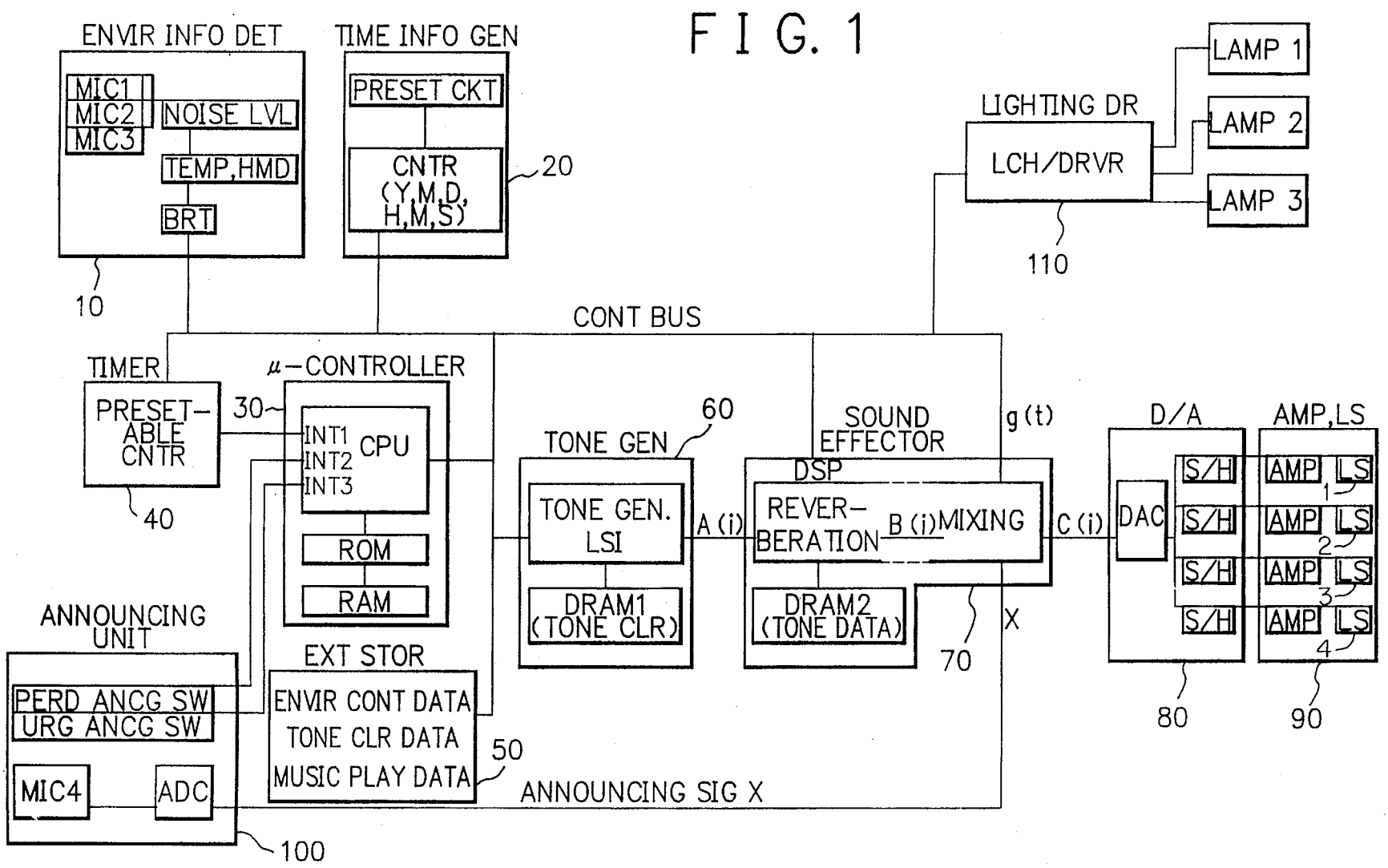
FIG. 1 is a block diagram showing the present invention.

FIG. 1 is a block diagram showing the present invention.

An environment information detector 10 repetitively detects environment information such as the noise level, temperature, humidity, brightness, and the like, and outputs the detected information to a μ-controller (to be simply referred to as a controller hereinafter) 30 as digital information.

A time information generator 20 forms date and time data (year, month, day, hour, minute, and second data) on the basis of master clocks obtained by quartz oscillation, and outputs them as digital information to the controller 30.

The controller 30 comprises a CPU, a ROM, a RAM, and an address decoder and gates (not shown) for organically coupling these components. The controller 30 receives the environment information, the time information, a timer state (to be described later), and an announcing request signal (to be described later) as digital information, and outputs signals from an external storage unit (to be described later) to a tone generator 60 and a sound effector 70 so as to generate tones with a corresponding tone color (including a natural tone), tone volume, tone pitch, play No. of tone sources, and tempo. The controller 30 also outputs a lighting driving signal to a lighting driver 110. The ROM stores a basic operation program, and processing is performed according to various tables and data stored in the external storage unit.

A timer 40 comprises a presettable counter, and is used for controlling time data when music information is played. For this purpose, the timer 40 down-counts preset data based on play tempo data sent from the controller 30, and outputs an interrupt signal (INT1) to the controller 30 at a predetermined time interval. The controller 30 utilizes this interrupt signal as time information "quarternote/24".

An external storage unit 50 comprises, e.g., a ROM card, a magnetic card, a floppy disk, a cassette tape, an optical disk, or the like, and is designed as a detachable storage unit under a condition that its content is changed for every season (spring, summer, fall, or winter) or every year.

The external storage unit 50 stores a noise condition table, a temperature•humidity condition table, a brightness condition table, and the like, and these tables store a plurality of kinds of data such as time control data, tone volume control data, tone color selection data, tempo control data, and tone pitch control data. In addition, the storage unit 50 also stores a plurality of music play data (including tempo speed data).

The tone generator 60 comprises a tone generation LSI and a DRAM1 for storing tone color data. The tone generator 60 time-divisionally generates 16 polyphonic tones on the basis of instruction information supplied from the controller 30, and performs sequence addition for distributing these tones to four loudspeakers 1–4. As the sequences of tone data to be distributed to the four loudspeakers, different tone data are output. For example, loudspeakers 1 and 3 respectively generate sounds of male and female small birds, or a sound of a locomotive is generated in the order of loudspeakers 1, 2, 3, and 4 as if the locomotive were moving.

The tone generator 60 has a sample output rate (output sampling frequency) for tone generation of 50 kHz. Since the tone generator 60 can simultaneously generate 16 tones (16-channel sound source), waveform read processing per tone is performed within a time period given by formula (1):

$$1/(50K\times16)=1.25\text{ msec} \quad (1)$$

Processing for each sequence is performed within a time period given by formula (2):

$$1/(50K\times16)\times4=5\text{ msec} \quad (2)$$

Therefore, the sound effector 70 connected to the output of the tone generator 60 also completes one sequence operation in 5 msec.

The sound effector 70 comprises a digital signal processor (to be abbreviated as DSP hereinafter), and a DRAM2 for time-serially storing four sequences of tone data. The sound effector 70 adds reverberation characteristics to a sequence-added tone signal A(i) output from the tone generator 60 in units of sequences (i) to obtain a sound signal B(i), mixes the sound signal B(i) and an announcing signal X, and outputs the mixed signal as a mixing signal C(i).

A D/A converter 80 time-divisionally converts four mixing signals C(i) output from the sound effector 70 into analog signals, samples and holds the analog signals, and outputs the sampled and held signals.

An amplifier/loudspeaker unit 90 amplifies the sampled and held analog signals, and produces tones corresponding to the analog signals from loudspeakers.

An announcing unit 100 is utilized as an auxiliary unit of the sound generation apparatus of the present invention. The announcing unit 100 forcibly reduces the tone volume of a sound signal B(i) periodically or in an emergency, and alternatively produces an announcing signal X input via a microphone through the amplifier/loudspeaker unit 90.

The announcing unit 100 comprises a microphone 4, an A/D converter, a periodical announcing request switch, and an urgent announcing request switch. These request switch signals serve as interrupt signals (INT2, INT3) to the controller 30.

A reverberation circuit and a mixing circuit are arithmetically controlled in a time-divisional manner by the single DSP. The mixing circuit performs processing using formula (3) in a normal play mode, formula (4) in a periodical announcing mode, and formula (5) in an urgent announcing mode. These formulas (3) to (5) are not fixed ones, and can be changed on the basis of environment information (in particular, noise information).

$$C(i)=B(i) \quad (3)$$

$$C(i)=B(i)\times0.3+X\times0.7 \quad (4)$$

$$c(i)=X \quad (5)$$

The lighting driver 110 is utilized as an auxiliary unit of the sound generation apparatus of the present invention. The controller 30 supplies a light driving signal to the lighting driver 110 from when the brightness level is decreased below a predetermined value in the evening until the brightness level is increased above the predetermined value in the next morning.

FIG. 2 shows sound control information and lighting control information based on environment information. Referring to the table shown in FIG. 2, no sound signal is output, and a light-ON state is set regardless of the brightness level during a time period between 20 o'clock and 4 o'clock even when environment information changes.

A plurality of basic patterns filled in a left-hand-side column of FIG. 2 are stored in the external storage unit 50, and one of these patterns is selected according to the date (the content of a register TDreg). The play numbers (assigned to stored tone sequences, respectively), and tone colors in which corresponding music data are played are changed according to the selected basic pattern. Time elements and the types of small bird or can are changed upon replacement of an external storage element for every season (spring, summer, fall, or winter). Of course, when the capacity of the external storage element is increased, sound control information throughout a year can be stored in a single element.

According to the table shown in FIG. 2, during a time period between 4 o'clock and 5 o'clock, lamps are turned off, and the output operation of a sound signal is started. During a time period between 18 o'clock and 19 o'clock, the lamps are turned on, and the output operation of a sound signal is ended. A precise ON/OFF time is determined by utilizing brightness information.

During a time period between 6 o'clock and 17 o'clock, music data selected based on environment information are automatically played for about 5 minutes at 1-hour intervals. Of course, other music data may be automatically played or other sounds of animals may be output during silent time periods. In principle, the silent time period is set to be longer than the tone generation time period. In place of the silent time period, a sound of slight wind or wave may be repetitively read out from waveform data and may be output through the loudspeakers all the time (or when neither auto-play nor output operation of a sound of a small bird is made).

According to the table shown in FIG. 2, the operating time control in the morning and evening, and tone volume•reverberation control of music data to be played are performed using noise information, and a change in sound of small bird, selection of play No., and tempo control are made using temperature•humidity information. In addition, operating time control in the morning and evening and tone pitch control are performed using brightness information.

The present invention is not limited to these combinations of environment information and the types of control, and they can be arbitrarily set. In lighting control, the brightness of the lamps may be controlled in correspondence with the brightness information in place of simple ON/OFF control.

Figure 3:
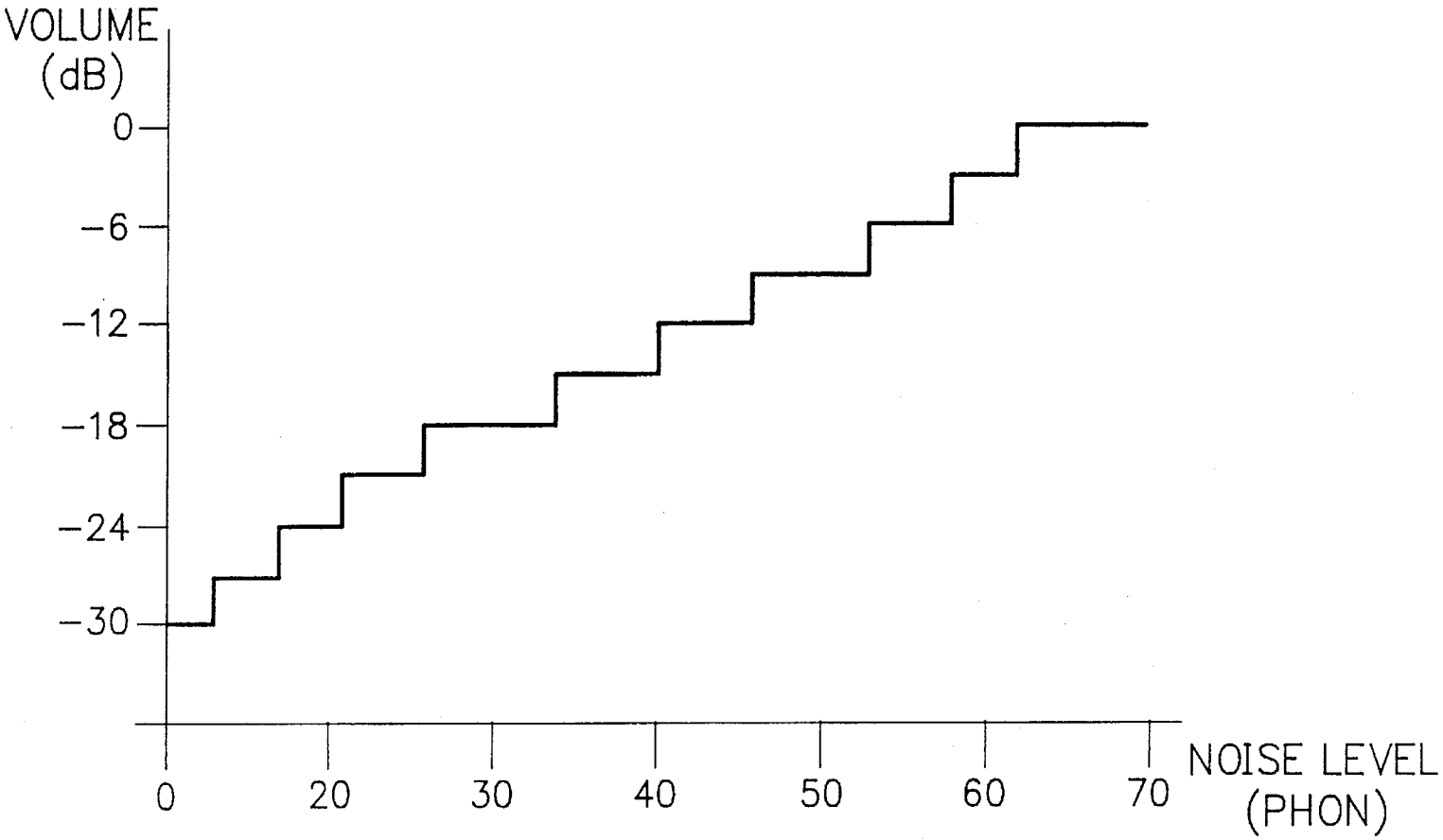
FIG. 3 is a graph showing the control rate of the tone volume with respect to the noise level.

FIG. 3 is a graph of tone volume/noise level control data. As can be seen from this graph, when the noise level is low, the tone volume is relatively suppressed; otherwise, the tone volume is relatively increased.

Figure 4:
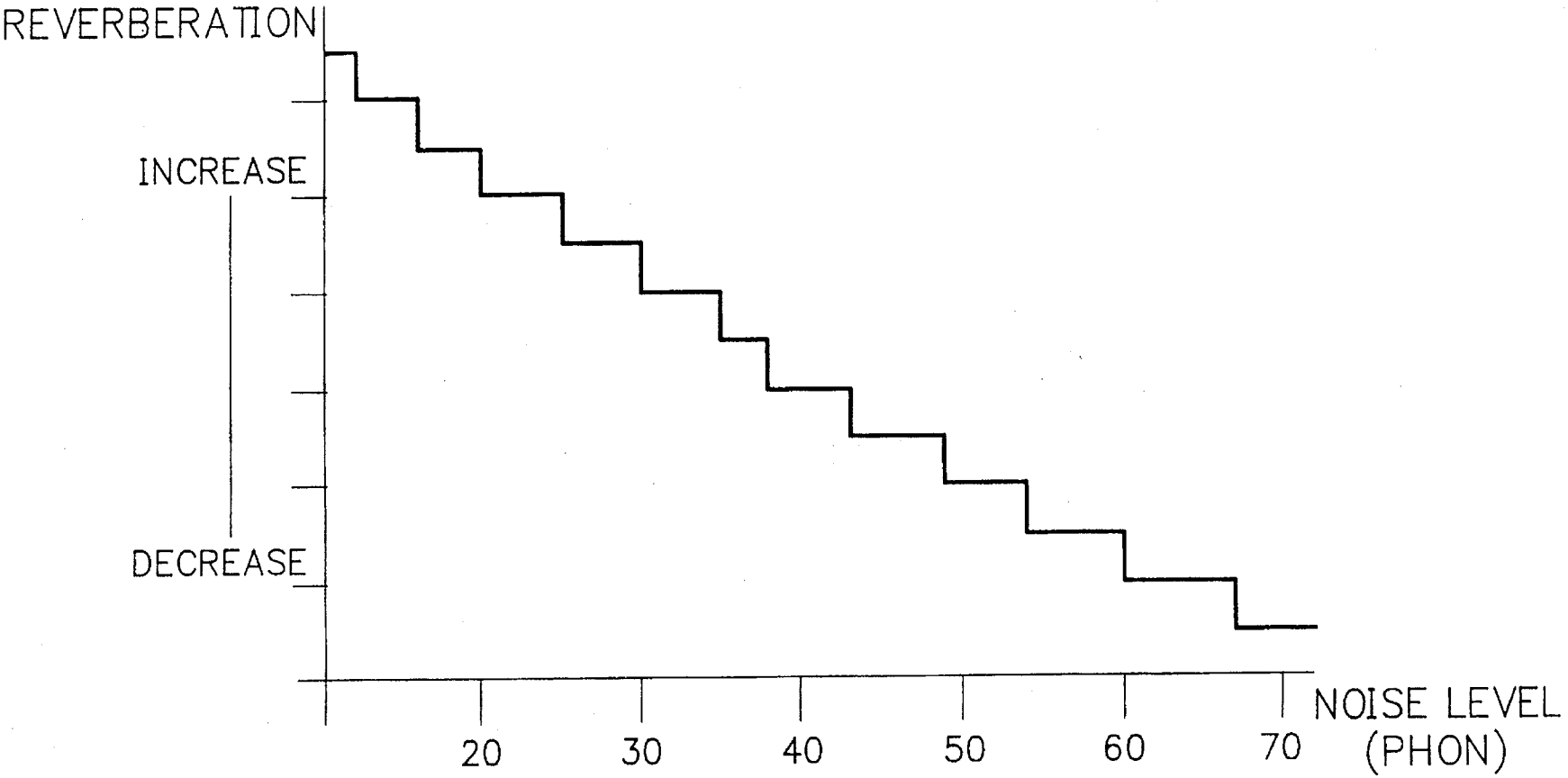
FIG. 4 is a graph showing the control rate of the reverberation level with respect to the noise level.

FIG. 4 is a graph of reverberation/noise level control data. As can be seen from this graph, when the noise level is low, the reverberation level is increased; otherwise, the reverberation level is decreased.

Figure 5:
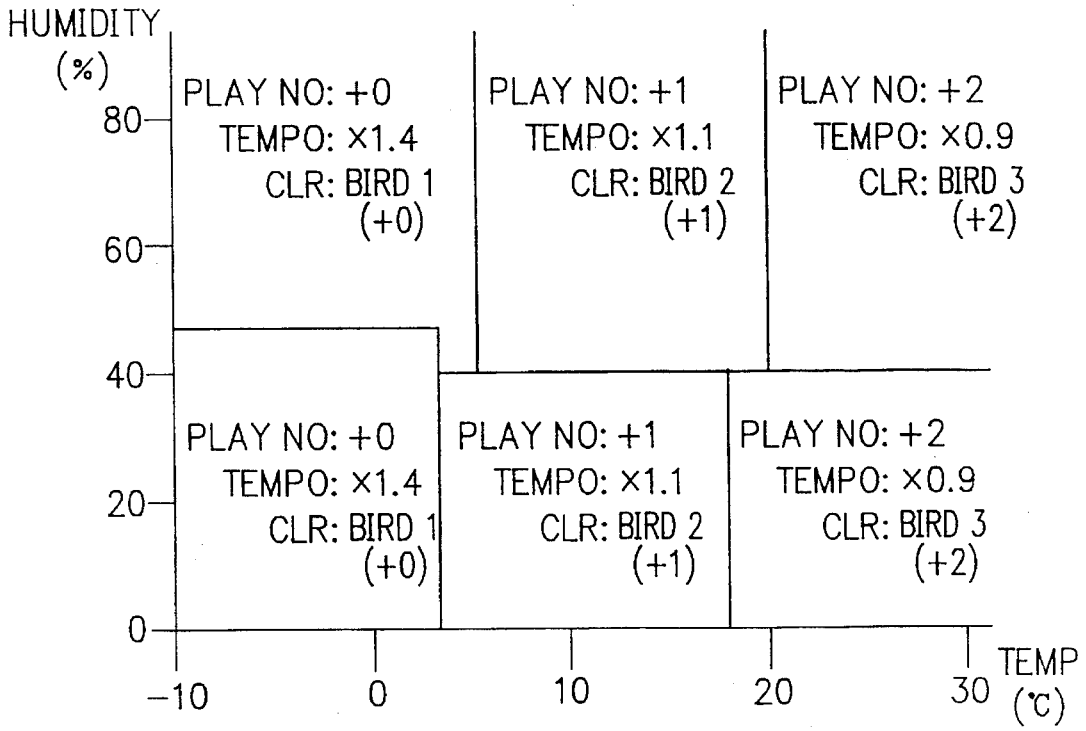
FIG. 5 is a graph showing the control rate of the play No., tempo, and tone color with respect to the temperature and humidity.

FIG. 5 is a graph of play No. selection•tempo/temperature•humidity control data. As can be seen from this graph, the play No. selection is biased according to a change in temperature, and the tempo speed is controlled according to a change in humidity. FIG. 5 is also used for biasing a tone color code. This control data graph is prepared in correspondence with each of play Nos. 1 to 12.

Figure 6:
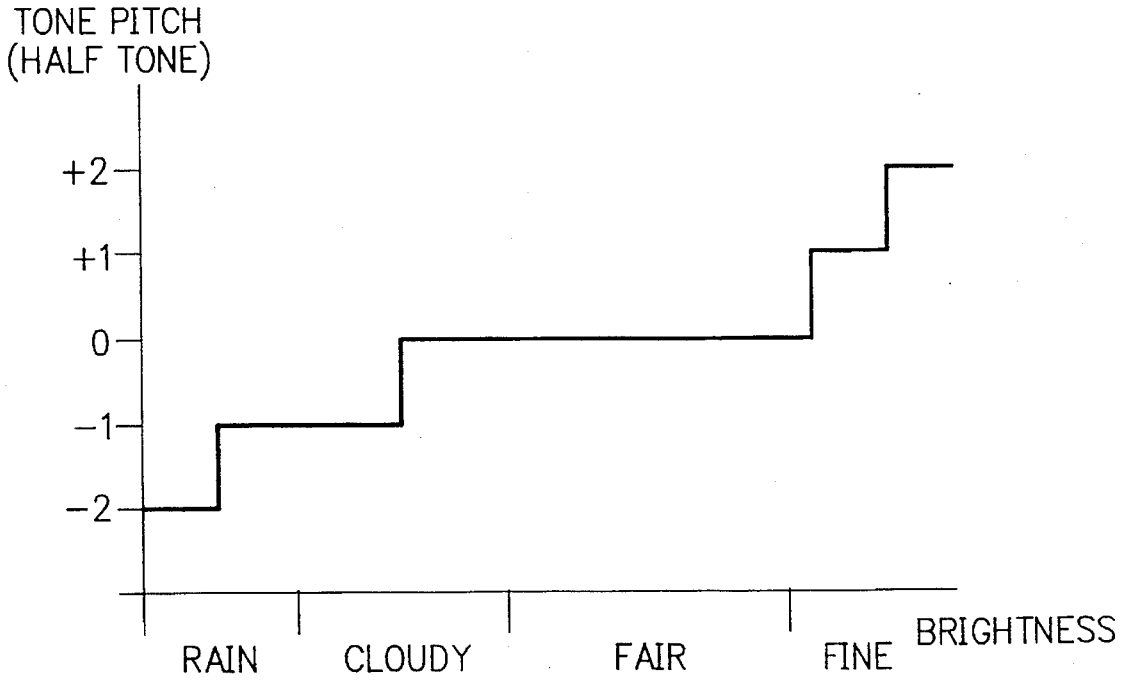
FIG. 6 is a graph showing the control rate of the tone pitch with respect to the brightness level.

FIG. 6 is a graph of tone pitch/brightness control data. As can be understood from this graph, when it is rainy or cloudy, the tone pitch is lowered by a half tone or one tone; when it is half-cloudy or fair, the preset tone pitch is used; and when it is a very bright, sunny day, the tone pitch is increased by a half tone or one tone.

Figure 7A:
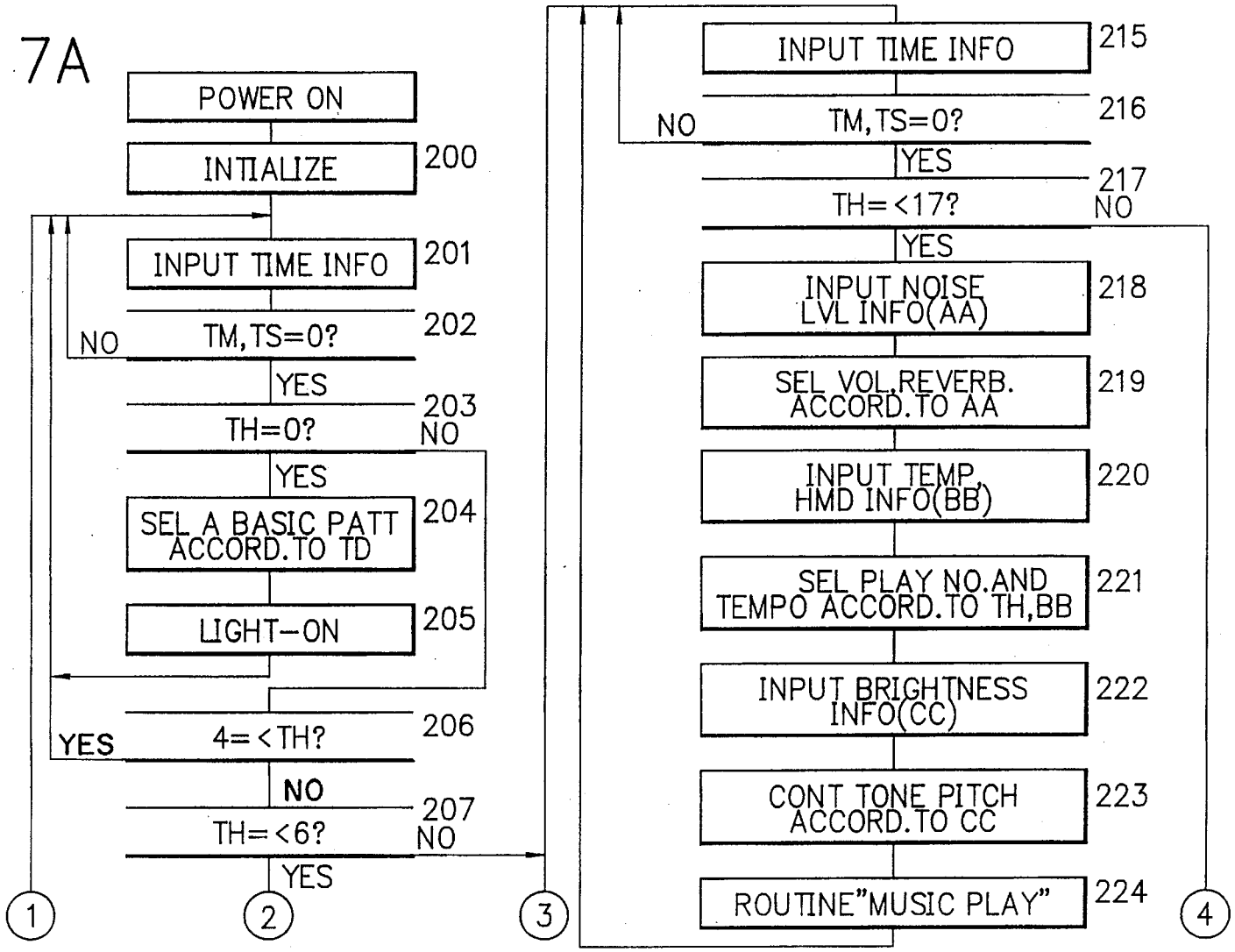
FIGS. 7A and 7B are flow charts of sound/lighting control based on environment information.
Figure 7B:
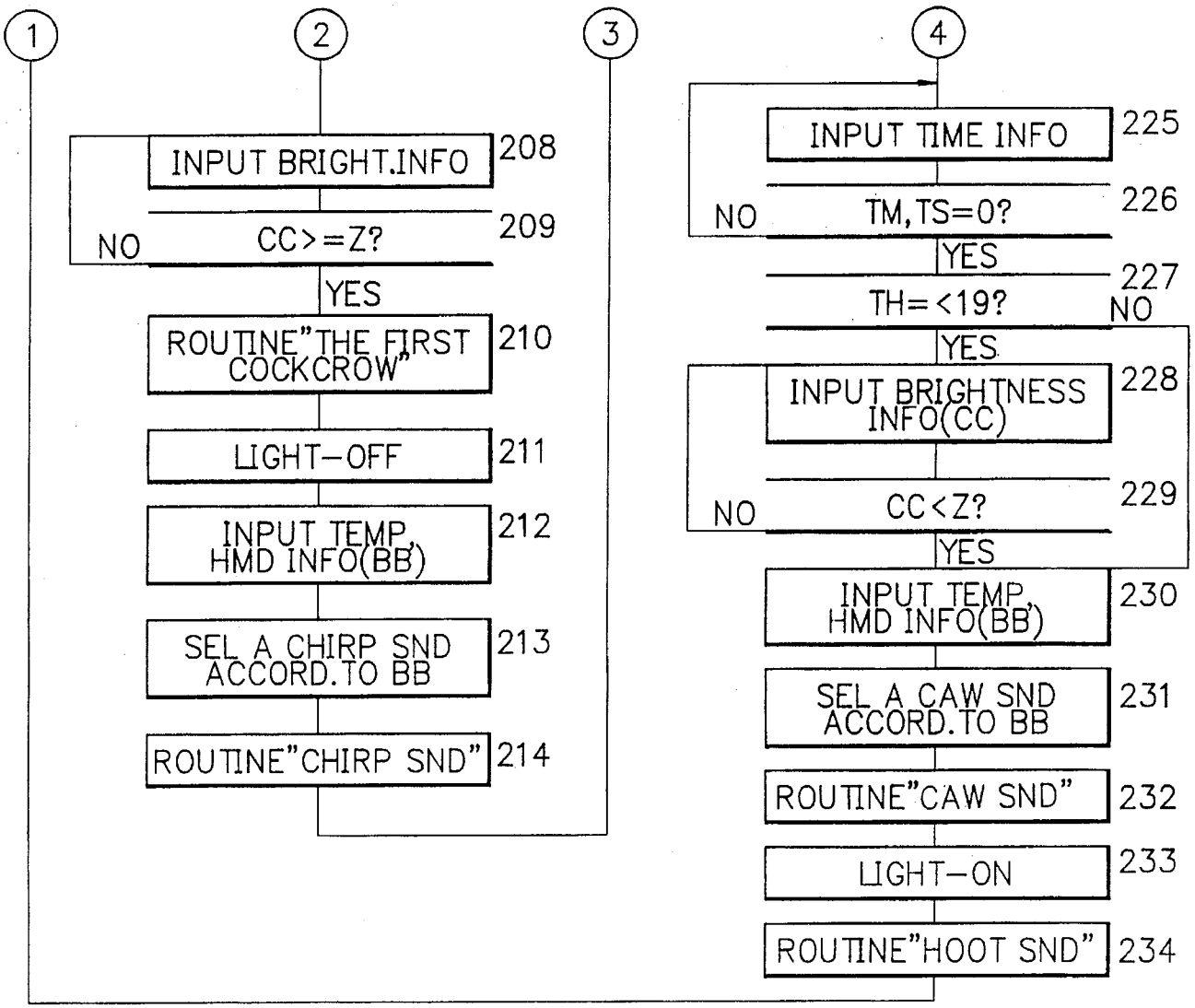

FIGS. 7A and 7B are flow charts showing sound or lighting control on the basis of environment information. After installation, the apparatus of this embodiment is normally ON. However, upon installation, the following preparation processing (step 200) is required as initialization processing.

First, the time data of the time information generator is preset to the current value. This operation is manually performed by a service person. Thereafter, a preset circuit of the time information generator 20 detects time broadcasting of a radio to automatically adjust the time data at 0 o'clock every day.

Second, the delay times (delayi0 to delayi3) of noise input signals (microphones 1, 2, and 3) and sound output signals (loudspeakers 1, 2, 3, and 4) are measured, and signal attenuation factors (Ki0 to Ki3) are measured. i is the type of microphone (i=1 to 3).

The flow in step 201 and subsequent steps corresponds to the main routine.

In step 201, time information is input. Upon reception of the time information from the time information generator 20, the controller 30 stores "date" data in a register TDreg, "hour" data in a register THreg, "minute" data in a register TMreg, and "second" data in a register TSreg.

In step 202, it is checked if TMreg=0 and TSreg=0. This is to detect a timing at which both the minute and second data are zero. Instead, the previous content of the register THreg may be stored in another register, and the content of the register THreg based on new time information may be compared with the previous content to detect a change in content. If YES in step 202, the flow advances to step 203; otherwise, the flow returns to step 201 to receive new time information.

If it is determined in step 203 that it is 0 o'clock, the sound control basic pattern based on environment information is selected on the basis of the content of the register TDreg in step 204. In step 205, the lamps are turned on, and the flow returns to step 201.

If it is determined in step 203 that the content of the register THreg is not "0", it is checked in step 206 if the content of the register THreg is equal to or smaller than 4. If YES in step 206, since no operation is made until 4 o'clock, the flow returns to step 201.

However, if NO in step 206, the flow advances to step 207, and it is checked if the content of the register THreg is equal to or smaller than 6. If YES in step 207, since the operating times of the sound generation apparatus and the lamps need be controlled, the flow advances to step 208, and brightness information (CC) is received. If it is determined in step 209 that the brightness information CC is equal to or larger than a predetermined value Z, it is determined that it is getting bright, and the flow advances to step 210 to start the operation of the sound generation apparatus of the present invention.

In step 210, a "first cockcrow" routine is called. In this routine, a sound "cock-a-doodle-doo" is generated three times at a predetermined time interval. In this flow, the time reaching step 210 varies. However, the "first cockcrow" routine may be called when step 208 is reached regardless of lighting control. Thus, the sound "cock-a-doodle-doo" is generated at 4 o'clock every morning.

The flow advances to step 211 to turn off the lamps. The flow then advances to step 212 to receive temperature•humidity information (BB). In step 213, a chirp sound is selected on the basis of the information BB. In step 214, a "chirp sound" routine is called. In this routine, if a "sparrow" sound, for example, is selected, a sound "chirp-chirp" is randomly generated for about 5 minutes. Upon completion of this operation, the flow advances to step 215.

The "chirp sound" includes "chirp-chirp", "chutt-chirp", "chitt-chitt-chirp", and the like (variations of chirping sounds), and the tone generation timing is varied rather than the tone color. Such different chirping sounds are stored to be assigned with different play Nos. More specifically, the sound "chirp-chirp", "chitt-chitt-chirp", or the like is stored as one sequence of a play No.

In step 215, time information is input. In step 16, it is checked if the input time information indicates TMreg=0 and TSreg=0. This is to detect a timing at which both the minute and second data are zero. If YES in step 216, the flow advances to step 217; otherwise, the flow returns to 215 to receive new time information.

If it is determined in step 217 that the content of the register THreg is equal to or smaller than 17, the flow advances to step 218, and noise level information (AA) is calculated. The calculation method will be described later. Thereafter, in step 219, tone volume control information and reverberation control information are read out with reference to the graphs in FIGS. 3 and 4 by utilizing the noise level information (AA). The tone volume control information is stored in a register AJVLreg, and the reverberation control information is stored in a register AJRVreg.

In step 220, temperature•humidity information (BB) is received. Preliminary play No. information corresponding to the content of the register THreg is stored in a register SNG by utilizing the information (BB) and the time information (the content of the register THreg) in step 221. Next, control information for biasing the preliminary play No. information with 0, 1, or 2 with reference to the graph of FIG. 5 on the basis of the information BB, and is stored in a register AJSGreg. Furthermore, tempo control information for controlling the tempo speed with respect to a preset tempo speed is read out with reference to the graph of FIG. 5 on the basis of the information BB, and is stored in a register AJTMreg.

In addition, data for biasing a tone color code to control the tone color may be read out by utilizing the graph of FIG. 5, and is stored in a register AJTNreg.

In step 222, brightness information (CC) is input, and the graph of FIG. 6 is looked up by utilizing the information (CC) to read out tone pitch control data. The tone pitch control data is stored in a register AJTRreg.

In step 224, a "music play" routine is called on the basis of the play No. control information (AJSG), tempo control information (AJTM), tone volume control information (AJVL), reverberation control information (AJRV), tone color control information (AJTN), and tone pitch control information (AJTR), and an auto-play operation is performed while controlling the parameters of the selected music piece. Upon completion of this auto-play operation, the flow returns to step 215 to prepare for the next auto-play operation about an hour later.

In step 225, time information is input, and it is checked in step 226 if the input time information indicates TMreg=0 and TSreg=0. This is to detect a timing at which both the minute and second data are zero. If YES in step 226, the flow advances to step 227; otherwise, the flow returns to step 225 to receive new time information.

If it is determined in step 227 that the content of the register THreg is equal to or smaller than 19, the flow advances to step 228 to receive brightness information (CC). If it is determined in step 229 that the brightness information (CC) is smaller than the predetermined value Z, it is determined that it is getting dark, and the flow advances to step 230 to stop the operation of the sound generation apparatus of the present invention. If it is determined in step 229 that the brightness information (CC) is not smaller than the predetermined value Z, the flow returns to step 228 to receive brightness information again. If it is determined in step 227 that the content of the register THreg is larger than 19, since this means that it is after 19 o'clock, the flow advances to step 230 to forcibly stop the operation of the sound generation apparatus of the present invention, and to turn on the lamps.

In step 230, temperature•humidity information (BB) is received. In step 231, a caw sound is selected based on the information BB. In step 232, a "caw sound" routine is called. In this routine, for example, a sound "caw-caw" is repeated for about 3 minutes at a predetermined time interval. Upon completion of this operation, the flow advances to step 233 to turn on the lamps.

Finally, in step 234, a "hoot sound" routine is called, and a sound "hoot-hoot" is generated about 10 times, thus ending today's sound generation. The "hoot sound" routine may be called at 22 o'clock. For this purpose, a routine for detecting whether or not the content of the register THreg reaches 22 may be added after step 233.

The chirp sound includes sounds of animals such as a sparrow, a bush warbler, a dove, or the like that chirp in the morning, and the caw sound includes sounds of animals such as a can, a bat, a "bell-ring" insect, a frog, and the like that caws, sings, or croaks in the evening. These sounds are stored in the external storage unit 50 as PCM data, are transferred to the DRAM1 as needed, and are produced as tones.

Figure 8:
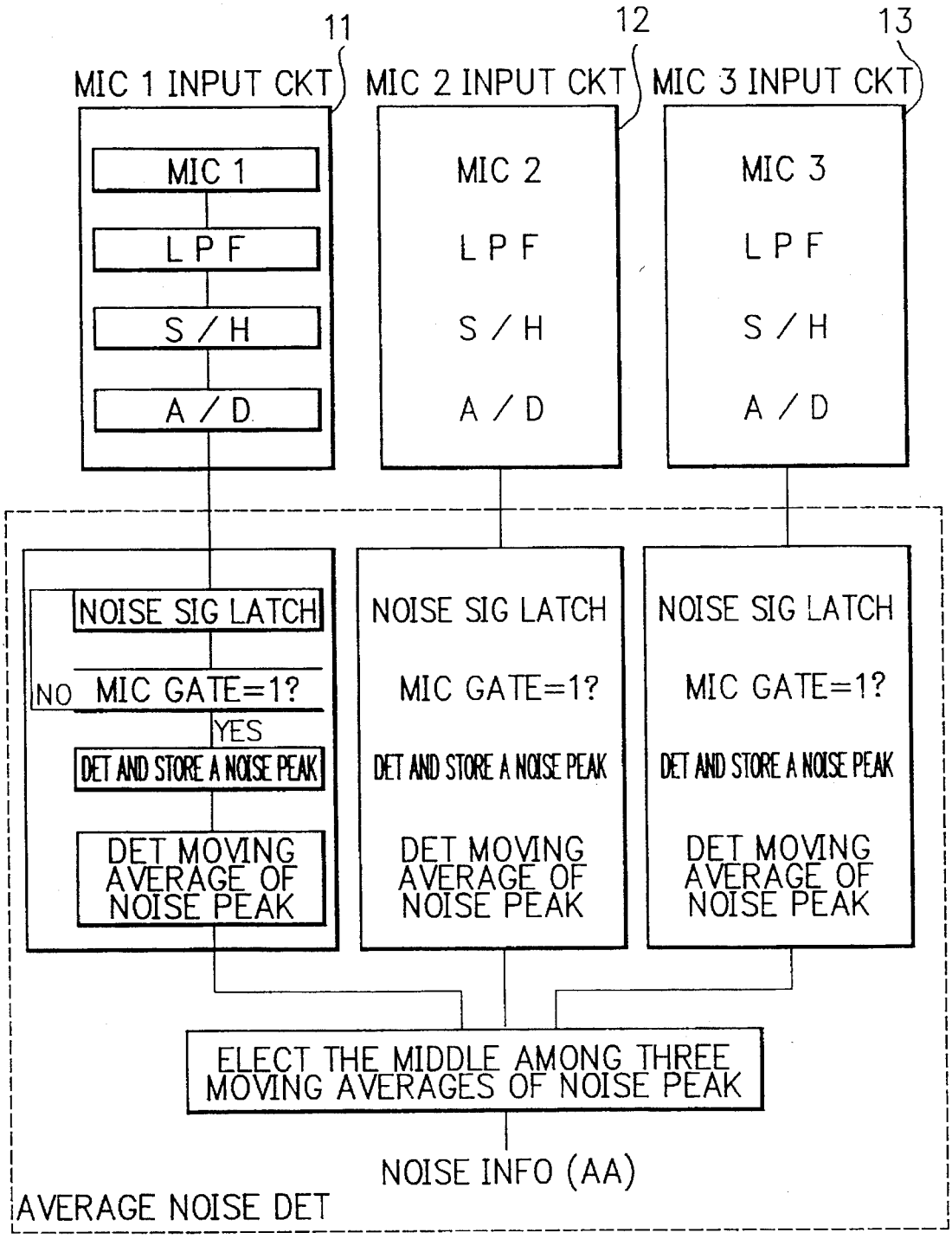
FIG. 8 is a diagram showing an example (first example) of noise detection means.

FIG. 8 shows an example of a noise detection means. This noise detection means (first example) comprises a microphone 1.input circuit 11 included in the environment information detector 10 and an average noise detector included in the controller 30.

In FIG. 8, three microphones are prepared for detecting a noise level. An input signal from each microphone is input to a low-pass filter to cut a high-frequency component, and is then input to a sample/hold circuit, so that an analog value is held at a rate of 10 kHz. Thereafter, the held analog value is converted into digital information through an A/D converter.

The digital noise information obtained in this manner for each of the microphones 1, 2, and 3 is supplied to the controller 30, and is latched as a noise signal at a rate of 10 kHz. Then, the controller 30 checks a microphone gate signal generated upon control of tone generation. As the microphone gate signal, "0" is output when sound signals are output from the loudspeakers 0 to 3 in FIG. 1; "1" is output when no sound signals are output. When the microphone gate signal is "0", the latched noise data is abandoned without being used. When the microphone gate signal is "1", the latched noise data is utilized as effective data, and it is checked if the latched noise data is larger than a noise peak (MAX in FIG. 9) updated every second. If the latched noise data is larger than the noise peak, the noise peak (MAX in FIG. 9) is updated. The noise peak is stored together with data for the past 60 seconds, and a moving average is calculated together with the noise peak for the past 60 seconds. Since a new value is added every second, the moving average in units of seconds is calculated at a 60-second interval. As for a second in which no noise input is obtained since the microphone gate signal is "0", the noise peak is stored as "0", and data at that time is omitted upon calculation of an average.

The moving average of the noise peak is calculated for each of the microphones 1, 2, and 3. Thereafter, of these values, noise peak moving average data having a middle value is utilized as noise information (AA) at that time. In this manner, when a sparrow sits and chirps on, e.g., the microphone 1, and this sound is detected as noise beyond environmental noise, the information from the microphone 1 can be ignored. When the microphone 3 is for example wrapped by a vinyl film blown by the wind from somewhere, and cannot perform precise noise detection, the information of the microphone 3 can be ignored.

Figure 9:
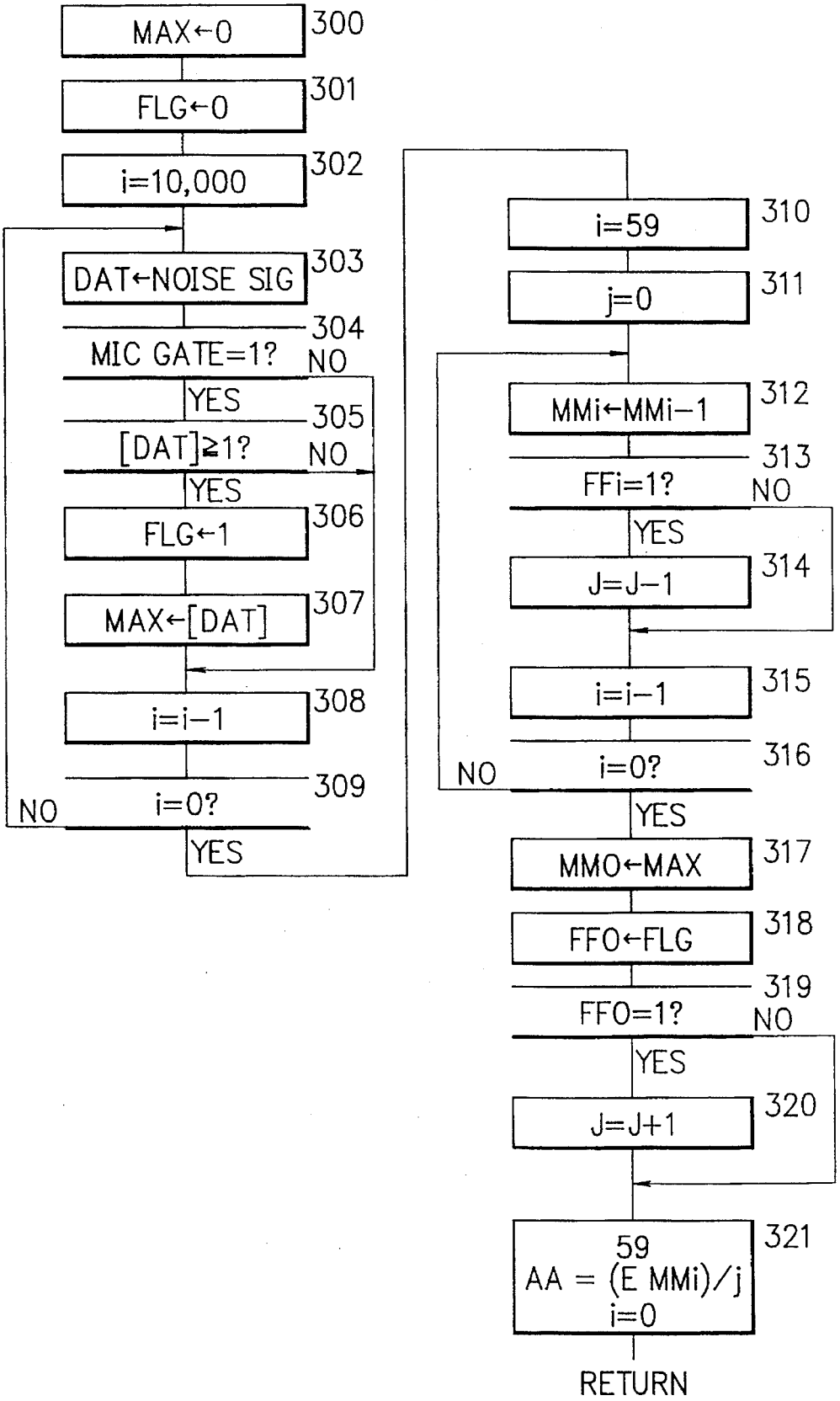
FIG. 9 is a flow chart of the noise detection means.

FIG. 9 is a flow chart showing a method of selecting middle data of three noise peak moving average data as noise information (AA) from a method of detecting the noise peak shown in FIG. 8.

In step 300, a register MAXreg for storing a maximum noise value for a predetermined period of time (1 second in this case) is cleared. In step 301, a register FLGreg for storing whether or not microphone inputs are enabled in the current 10,000 samples is cleared. In step 302, "10,000" is set in a register ireg for storing the number of samples. In step 303, noise data is input in synchronism with a sampling frequency of 10 kHz, and is stored in a register DATreg. In step 304, it is checked if the microphone gate signal is "1". If YES in step 304, since the stored noise data is effective, the flow advances to step 305; otherwise, the flow jumps to step 308.

In step 305, it is checked if the absolute value [DAT] of the currently input noise data DAT is equal to or larger than the maximum noise data MAX so far. If YES in step 305, the flow advances to step 306, and FLGreg=1 is set. In step 307, the absolute value [DAT] of the current noise data DAT is stored in the register MAXreg. In step 308, the content of the register ireg is decremented by one. In step 309, it is checked if the content of the register ireg has reached 0. If YES in step 309, the flow advances to step 310; otherwise, the flow returns to step 303 to wait for the next input noise data.

In steps 310 to 316, the contents (MM0 to MM59) of maximum noise data for 60 minutes are shifted register by register, and simultaneously with this shift operation, the number of effective maximum noise data of the 60 data is stored in a register jreg.

In step 317, the current maximum noise data is stored in a register MM0reg, and in step 318, data indicating whether or not the current maximum noise data is effective is stored in a register FF0reg. In step 319, it is checked if the current maximum noise data is effective. If YES in step 319, the content of the register jreg is incremented by one in step 320; otherwise, the flow jumps to step 321.

In step 321, an average of effective data of the 60 maximum noise data stored in the registers MM0 to MM59 is calculated, and is determined as noise information (AA).

Brightness information is also calculated after a plurality of input circuits calculate moving averages of data over time in the same manner as noise information. Temperature•humidity information can be obtained by an easier method.

In the noise detection means (first example) shown in FIG. 8, the tone volumes of tones generated from the four loudspeakers of the sound generation apparatus must be allowed to cancel each other upon detection of the noise level, and for this reason, the microphone gate signal is used. Of course, although very high precision cannot be maintained due to, e.g., the presence of reflected tones, no problem is posed in a practical use. In addition, the microphone gate signal may be set to be "1" if it is determined that a sound output from the loudspeaker does not influence the microphone input.

Figure 10:
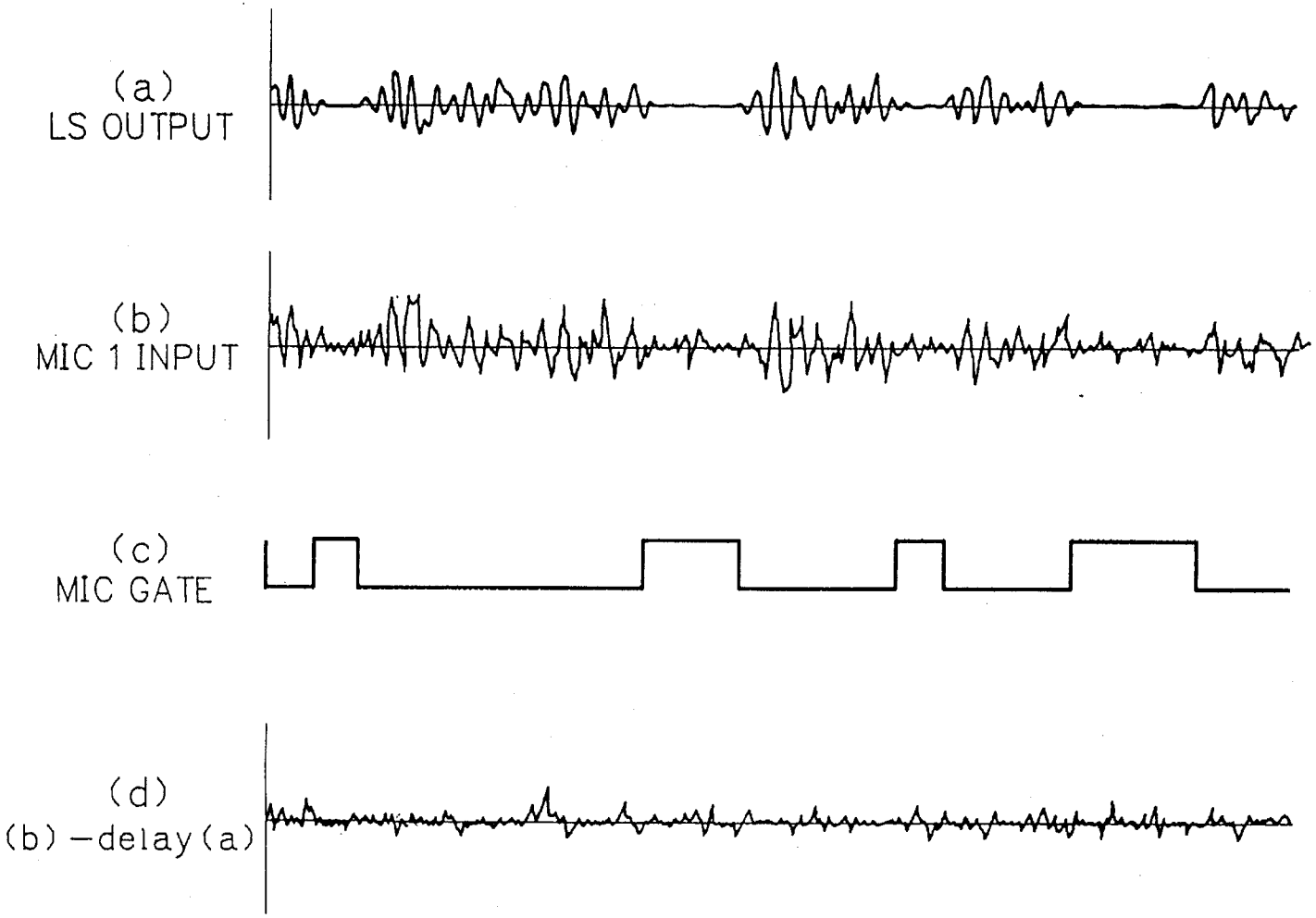
FIG. 10 is a chart showing input examples of noise information.

FIG. 10 shows the relationship among sound output signals from the loudspeakers 0 to 3, noise input signals from the microphones 1 to 3, and the microphone gate signal. A signal (a) corresponds to a sound output signal output from the loudspeaker 1. A signal (b) corresponds to a noise input signal from the microphone 1 of the noise detection means. A signal (c) corresponds to the microphone gate signal generated by the controller 30. A signal (d) is obtained by digitally canceling the sound output signal component from the microphone input signal by (b)—delay(a) (subtraction of a delayed signal (a) from a signal (b)).

Figure 11:
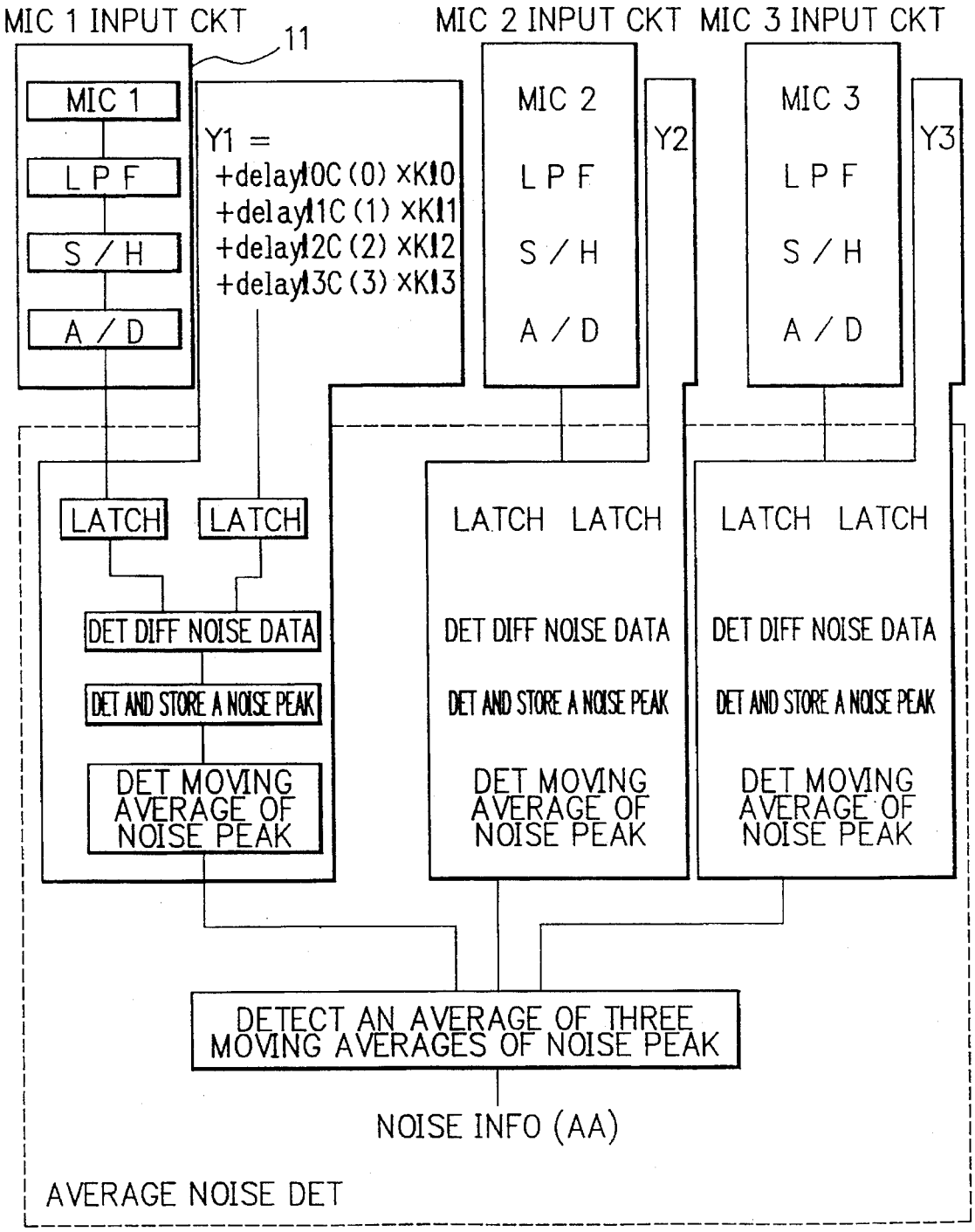
FIG. 11 is a diagram showing an example (second example) of noise detection means.

FIG. 11 shows a means for generating the signal (d) in FIG. 10. The microphone 1 input circuit 11 is the same as that shown in FIG. 8. Each digital noise information is supplied to and latched by the controller, and at the same time, a sound signal transmission factor from each sound loudspeaker at the position of the microphone is calculated and latched. This sound signal transmission factor is calculated using formula (6):

$$Y1=\text{delay}l0\ C(0)\times Kl0+\text{delay}l1\ C(1)\times Kl1+\text{delay}l2\ C(2)\times Kl2+\text{delay}l3\ C(3)\times Kl3 \quad (6)$$

C(i) (i=1 to 3) represents the four sequences of independent signal signals output from the mixing circuit, and delayli represents the delay time from the corresponding loudspeaker to the position of the microphone 1. Kli represents the attenuation factor of the tone volume of a tone output from the corresponding loudspeaker until the tone reaches the microphone 1. These coefficient values are determined by actual measurements. As can be understood from this calculation method, transmission factors Y2 and Y3 are similarly obtained for the microphones 2 and 3.

Another difference in the average noise detector in FIG. 11 is that an average of three moving average data is finally determined as noise information (AA). In this manner, an average may be used, or moving average data having a middle value may be used. Although various other methods may be employed, it is important to mask a locally abnormal phenomenon or a partial error, which cannot be canceled by one input information.

The above-mentioned calculation does not take reflection into consideration, either. However, a more precise calculation may be made in consideration of fences and signboards near the apparatus so as to correct an error caused by reflection.

The storage format of parameters used in music data will be explained below. Data used in music data has a format in units of 4 bytes, as shown in FIG. 12.

A step time in the first byte (PNT (pointer)+0) indicates data obtained by storing the absolute time from the previous bar information in units of intervals 1/24 a quarternote. Various kinds of information in the second byte (PNT+1) such as key-ON information, key-OFF information, tone color information, tempo information, tone volume information, reverberation information, and the like are command information in the MIDI standards, and indicate the types of next information. The third byte (PNT+2) stores various kinds of data corresponding to the type. An ON/OFF velocity in the fourth byte (PNT+3) indicates a key depression/release speed, and a beat code indicates the number of beats per bar, i.e., a time.

However, at the beginning of play information, 4-byte data shown in FIG. 13 is always stored unlike the above-mentioned data. This is to efficiently provide indispensable play data at the beginning of a play. A tempo speed in the first byte (PNT+0) designates a play tempo. A tone color code in the second byte (PNT+1) designates a tone color code of tones to be played. The third byte (PNT+2) designates a tone volume. The fourth byte (PNT+3) designates a reverberation level.

Figure 14:
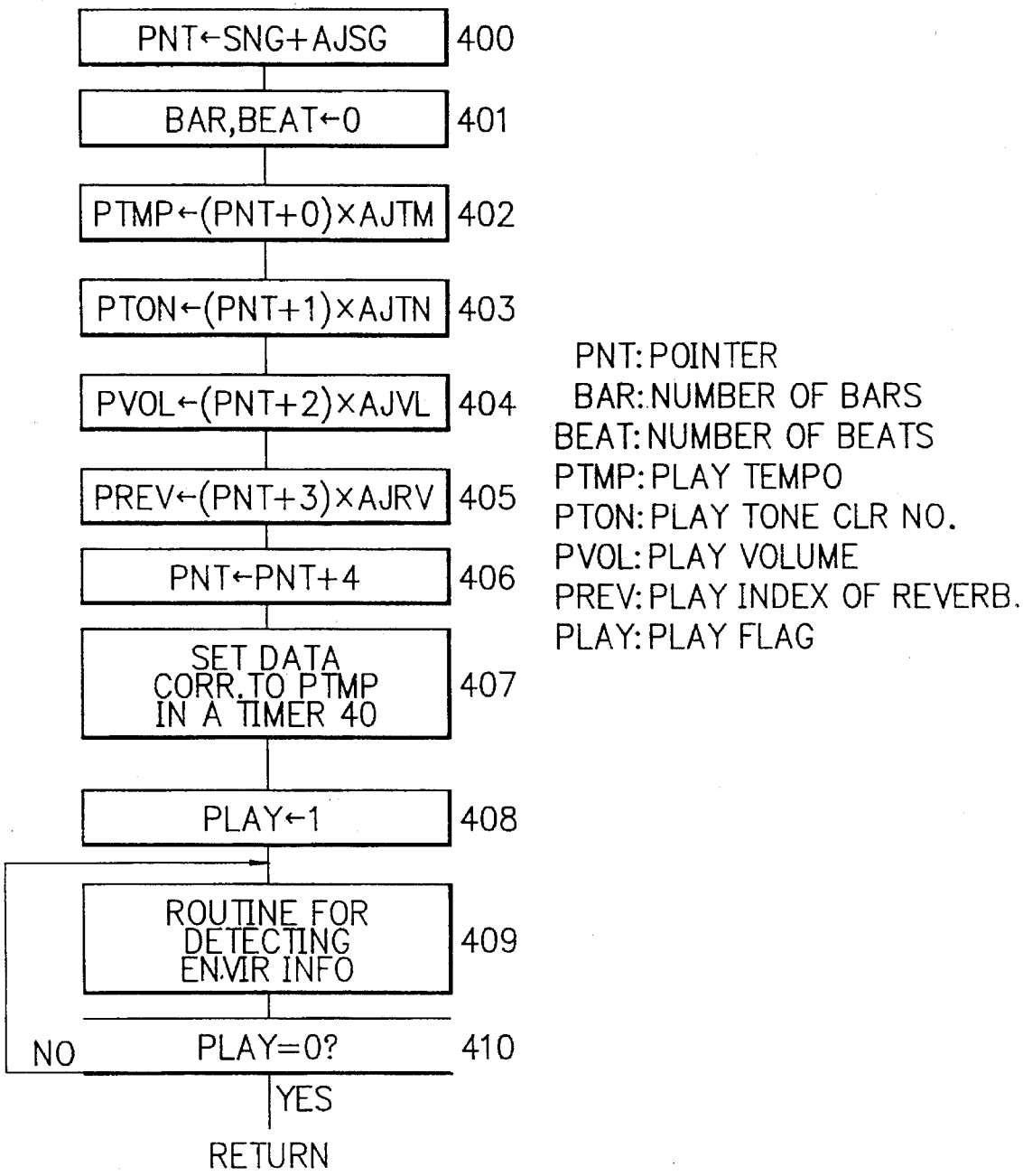
FIG. 14 is a flow chart showing a "music play" routine.

FIG. 14 is a flow chart showing the "music play" routine. In the "music play" routine, sound parameters are adjusted and controlled on the basis of the contents of the following seven registers. The seven registers respectively store preliminary play No. information (SNGreg), play No. control information (AJSGreg), tempo control information (AJTMreg), tone color control information (AJTNreg), tone volume control information (AJVLreg), reverberation control information (AJRVreg), and tone pitch control information (AJTRreg).

In step 400, the preliminary play No. information SNGreg is added to corresponding bias information AJSGreg, and the sum is determined as a play No. to be actually played. The start address of corresponding music data is stored in a pointer PNT. In step 401, registers BARreg and BEATreg for respectively storing bar and beat (1/24 a quarternote) data of music data are cleared.

In step 402, a product of tempo speed data (PNT+0) stored at the beginning of music data and the tempo control information AJTMreg is stored in a register PTMPreg. In step 403, a sum of tone color code data (PNT+1) stored at the beginning of music data and the tone color control information AJTNreg is stored in a register PTONreg. In step 404, a product of tone volume code data (PNT+2) stored at the beginning of music data and the tone volume control information AJVLreg is stored in a register PVOLreg. In step 405, a product of reverberation code data (PNT+2) stored at the beginning of music data and the reverberation control information AJRVreg is stored in a register PREVreg.

In step 406, the content of the pointer is incremented by 4. In step 407, the play tempo speed information stored in the register PTMPreg is read out, and data corresponding to the readout information is set in the timer 40. In step 408, "1" is set in a play flag PLAY indicating that a play operation is being performed.

Steps 409 and 410 constitute a wait routine during the play operation. In this routine, environment information is detected in step 409, and is reflected in play parameters. Processing associated with the play operation is executed in an INT1 routine (to be described below). Since "0" is set in the play flag upon completion of the play operation, the change in play flag is detected in step 410, and the control returns from the "music play" routine to the main routine.

Figure 15:
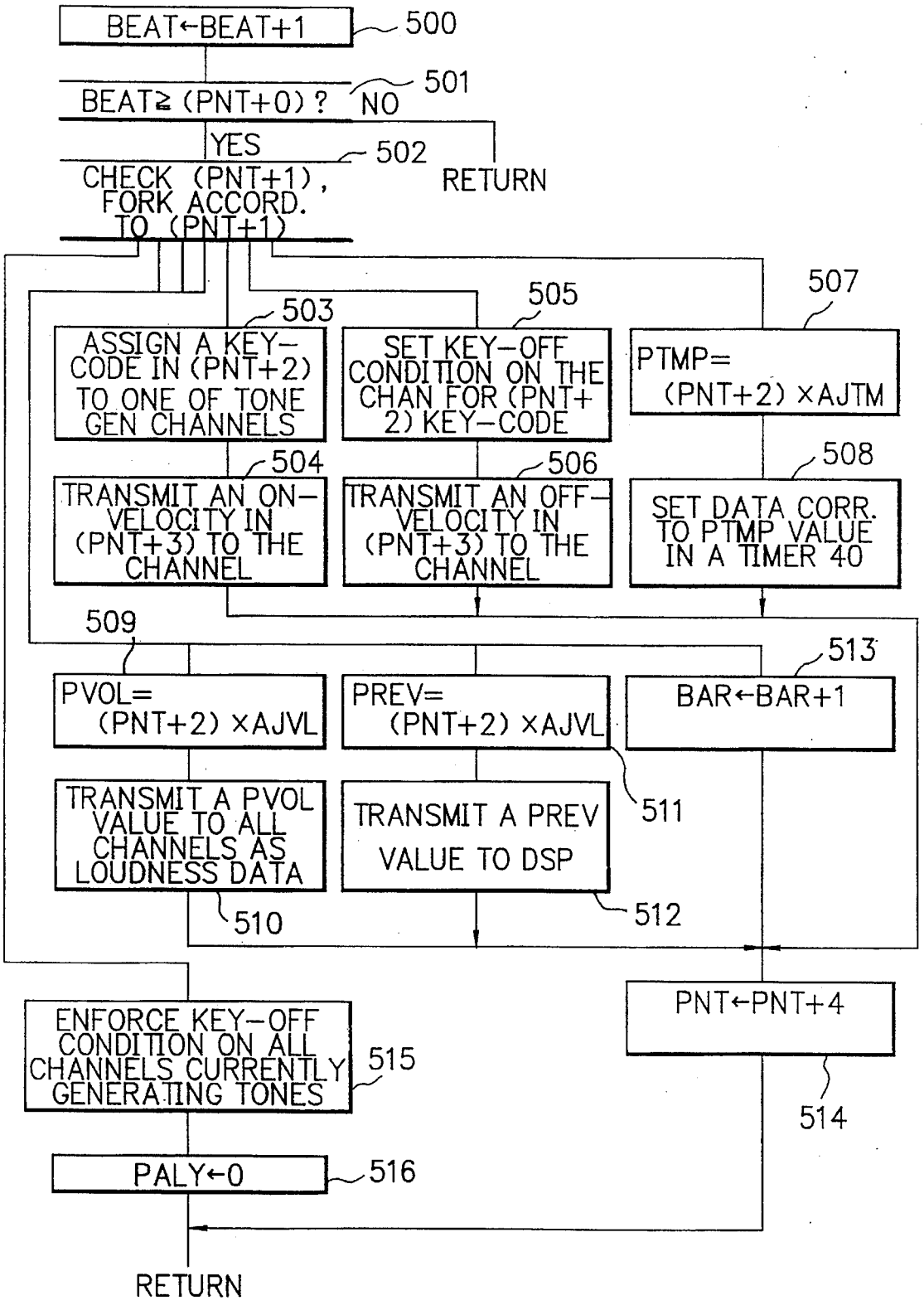
FIG. 15 is a flow chart showing an INT1 routine.

The INT1 routine will be described below with reference to FIG. 15. In step 500, BEAT data is incremented by one. If it is determined in step 501 that the BEAT data is equal to or larger than the step time indicated by the content of (PNT+0), it is determined that the timing for reading out the next 4-byte data has been reached, and the flow advances to step 502. Otherwise, the flow returns to the main routine. In step 502, the type of 4-byte data is detected based on the content of (PNT+1), and the flow jumps to one of seven flows in correspondence with the detected type of data.

The flow advances to step 503 when key-ON information is read out. In step 503, a key code is read out, and is biased by the tone pitch control information AJTR. Thereafter, the biased key code is assigned to one of 16 tone generation channels, and a tone generation instruction is issued to the tone generator 60. In step 504, an ON-velocity is read out, and is output to the corresponding channel of the tone generation LSI.

The flow advances to step 505 when key-OFF information is read out. In step 505, a tone generation channel corresponding to the readout key code is searched, and an instruction is issued to the tone generation LSI to set the searched channel in a key-OFF state. In step 507, an OFF-velocity is read out, and is output to the corresponding channel of the tone generation LSI.

The flow advances to step 507 when tempo information is read out. In step 507, a product of the readout tempo information and the tempo control information AJTMreg is stored in the register PTMPreg. In step 508, data corresponding to the value in the register PTMPreg is set in the timer 40. Thus, the tempo speed can change even during the play operation.

The flow advances to step 509 when tone volume information is read out. In step 509, a product of the readout tone volume information and the tone volume control information AJVLreg is stored in the register PVOLreg. In step 510, the value in the register PVOLreg is output as loudness data of an envelope to the channels of the tone generation LSI.

The flow advances to step 511 when reverberation information is read out. In step 511, a product of the readout reverberation information and the reverberation control information AJRVreg is stored in the register PREVreg. In step 512, the value in the register PREVreg is output to the DSP.

The flow advances to step 513 when bar information is read out. In step 513, the content of the register BARreg is incremented by one when this information is read out. After the above-mentioned six flows, the flow then advances to step 514, and the value of the pointer PNT is incremented by 4 to read out the next play information. Thereafter, the flow returns to the main routine.

Finally, the flow advances to step 515 when play end information is read out. When this information is read out, an instruction is issued to the tone generation LSI to forcibly set all the channels in tone generation in an OFF state. In step 516, "0" is set in the play flag to indicate the end of play operation, and the flow returns to the main routine.

The details of the storage and read operations of play information are described in Japanese Patent Application No. 1-265880 filed by the present applicant, and the details of the tone generation LSI are described in Japanese Patent Application No. 63-281099. Since the storage/read operations of play information and the tone generation LSI can be easily designed by those who are skilled in the art with reference to these prior arts, a detailed description thereof will be omitted here.

The present invention is not limited to the above embodiment, and various changes and modifications may be made without departing from the spirit and scope of the invention. For example, as environment information, the degree of crowd may be checked, or as weather information, snow and rain, a wind velocity, or an earthquake may be detected.

As described above, the sound generation apparatus of the present invention receives environment information (noise level, humidity, temperature, brightness, and the like) of a place where it is installed, and controls the play No., tone volume, tone pitch, tempo, reverberation, and the like of a sound output from the loudspeakers on the basis of the environment information. Thus, people can enjoy the gentle and comfortable sound. Since lighting control is performed by utilizing the environment information (especially, noise information) and time information, energy required for lighting can be minimized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sound generation apparatus installed in a public space, comprising:

ambient environment information detection means for detecting at least two types of environment information, such information including ambient noise level information, and at least one of ambient temperature information, ambient humidity information, and ambient brightness information, such information being detected near a place where said sound generation apparatus is installed;

control data generation means for storing a plurality of samples of the ambient environment information in serial time sequence, and generating tone control data for controlling at least one of a tone color, a tone pitch, a play number assigned to a stored tone source, and a tempo, on the basis of the plurality of samples of environment information;

time means for producing time data;

input means, responsive to the time means, for causing the control data generation means to accept new data from the ambient environment information detection means at predetermined intervals;

tone generation means for generating digital tone generation data on the basis of the tone control data;

D/A conversion means for converting the digital tone generation data into analog tone signals;

tone production means for amplifying the analog tone signals, and producing output sounds corresponding to the analog tone signals; and means for cancelling the sound signal, corresponding to the sound output by the tone production means, from the environment information detected by the ambient environment information detection means, via subtracting the sound signal from the environment information;

wherein the control data generation means generates new tone control data in response to receiving new data from the environment information detection means such that the sound generation apparatus responds at said predetermined intervals to changes in the environment information.

2. An apparatus according to claim 1, further comprising:

at least one controllable light; wherein said control data generation means further outputs data for lighting control of the at least one controllable light.

3. An apparatus according to claim 1, wherein said tone generation means comprises storage means for storing pulse code modulation sound source data of at least one of instrument tones, human voices, sounds of animals, natural tones, and artificial tones, and controls the tone generation data including at least one of the tone color, the tone pitch, a tone volume, the tempo, and play numbers assigned to stored tone sources, on the basis of the sound source data in accordance with the tone control data.

4. An apparatus according to claim 1, wherein said tone generation means comprises sound effect means, and adds at least a reverberation effect to the digital tone generation data on the basis of the tone control data.

5. An apparatus according to claim 1, wherein said control data generation means generates control data for controlling a tone volume on the basis of an ambient noise level.

6. An apparatus according to claim 1, wherein said control data generation means generates control data for at least one of controlling a tempo of tones to be generated and selects a play number assigned to a stored tone source on the basis of a temperature and a humidity.

7. An apparatus according to claim 1, wherein said control data generation means generates control data for controlling a pitch of tones to be generated on the basis of an ambient brightness level.

8. An apparatus according to claim 1, wherein said control data generation means generates control data for controlling the tone color on the basis of a temperature and a humidity.

9. An apparatus according to claim 1, wherein said control data generation means generates control data for controlling a reverberation level of tones to be generated on the basis of an ambient noise level.

10. An apparatus according to claim 3, wherein said control data generation means includes time information generation means for generating month information, day information, and time information which are used for selection of one of play numbers assigned to the stored tone sources.

11. An apparatus according to claim 10, wherein a play pattern is changed according to the tone control data.

12. An apparatus as in claim 1, wherein:

each predetermined interval is substantially one hour.

13. A method for generating at least one tone signal comprising the steps of:

a) sampling, at predetermined intervals, ambient noise and at least one of ambient temperature, ambient humidity, and ambient brightness, and outputting at least two samples, respectively;

b) determining, after each new sampling, at least one tone parameter as a function of the samples, respectively;

c) generating at least one tone signal as a function of the at least one tone parameter; and d) cancelling the tone signal from the ambient noise sample via subtracting the tone signal from the ambient noise sample;

wherein steps a) and b) have a repetitive relation, the method responding at said predetermined intervals to changes in the ambient environment according to the repetitive relation of steps a) and b).

14. A method as in claim 13, wherein:

the step b) of determining a tone parameter determines at least one of tone color, tone pitch, a play number assigned to a stored tone source, and tempo.

15. A method as in claim 13, wherein:

the step a) of sampling samples ambient noise, and samples at least two of ambient temperature, ambient humidity, and ambient brightness.

16. A method as in claim 13, further comprising:

storing the at least two samples.

17. A method as in claim 16, wherein:

the samples are stored in serial time sequence.

18. A method as in claim 13, further comprising:

generating at least one sound corresponding to the at least one tone signal, respectively.

19. A method as in claim 13, further comprising:

generating at least one lamp control signal as a function of the at least two samples for controlling at least one controllable light.

20. A method as in claim 13, further comprising:

storing sound source data corresponding to at least one of instrument sounds, human voice sounds, animal sounds, nature sounds, and artificial sounds; and the step of generating at least one tone signal generates as a function of both the sound source data and the at least one tone parameter.

21. A method as in claim 13, further comprising:

adding a sound effect to the at least one tone signal.

22. A method as in claim 21, wherein:

the sound effect is reverberation.

23. A method as in claim 22, wherein:

the reverberation is adjusted as a function of the ambient noise sample.

24. A method as in claim 13, wherein:

the method further comprising the step of modulating an amplitude of the at least one tone signal as a function of the ambient noise sample.

25. A method as in claim 13, wherein:

samples taken include an ambient temperature sample and an ambient humidity sample.

26. A method as in claim 25, further comprising:

selecting the parameter of a play number assigned to a stored tone source as a function of the ambient temperature sample and the ambient humidity sample.

27. A method as in claim 25, further comprising:

adjusting tone color as a function of the temperature sample and the humidity sample.

28. A method as in claim 25, further comprising:

adjusting at least two parameters, including tone color and a play number assigned to a stored tone source, as a function of the temperature sample and the humidity sample.

29. A method as in claim 13, wherein:

the at least one parameter is tone pitch; and adjusting the parameter of pitch as a function of the ambient brightness.

30. A method as in claim 20, wherein:

the at least one parameter is a play number assigned to a stored tone source; and one of the play numbers assigned to the stored tone sources is selected on the basis of month information, day information, and time information.

31. A method as in claim 20, wherein:

the sound source data is pulse code modulated data.

32. A method as in claim 13, wherein:

each predetermined interval is substantially one hour.

33. A sound generation apparatus installed in a public space, comprising:

calendar information detection means for detecting calendar information, such information including month, week of the month, day of the month, and time of the day;

ambient environment information detection means for detecting environment information including at least one of ambient noise level information, ambient temperature information, ambient humidity information, and ambient brightness information, such information being detected near a place where said sound generation apparatus is installed;

control data generation means for storing a plurality of samples of the ambient environment information in serial time sequence, and generating tone control data for controlling at least one of a tone color, a tone pitch, a play number assigned to a stored tone source, and a tempo, on the basis of the detected calendar information and environment information; time means for producing time data;

time means for producing time data;

input means, responsive to the time means, for causing the control data generation means to accept new data from the ambient environment information detection means at predetermined intervals;

tone generation means for generating digital tone generation data on the basis of the tone control data;

D/A conversion means for converting the digital tone generation data into analog tone signals;

tone production means for amplifying the analog tone signals, and producing output sounds corresponding to the analog tone signals; and means for cancelling the sound signal, corresponding to the sound output by the tone production means, from the environment information detected by the ambient environment information detection means, via subtracting the sound signal from the environment information;

wherein the control data generation means generates new tone control data in response to receiving new data from the ambient environment information detection means such that the sound generation apparatus responds at said predetermined intervals to changes in the environment information.

34. An apparatus according to claim 33, further comprising:

at least one controllable light; wherein said control data generation means further outputs data for lighting control of the at least one controllable light.

35. An apparatus according to claim 33, wherein said tone generation means comprises sound effect means, and adds at least a reverberation effect to the digital tone generation data on the basis of the tone control data.

36. An apparatus according to claim 33, wherein said control data generation means generates control data for controlling a tone volume on the basis of an ambient noise level.

37. An apparatus according to claim 33, wherein said control data generation means generates control data for at least one of controlling a tempo of tones to be generated and selects a play number assigned to a stored tone source on the basis of a temperature and a humidity.

38. An apparatus according to claim 33, wherein said control data generation means generates control data for controlling a reverberation level of tones to be generated on the basis of an ambient noise level.

39. An apparatus as in claim 33, wherein:

each predetermined interval is substantially one hour.

40. A method for generating at least one tone signal comprising the steps of:

a) detecting calendar information, such information including month, week of the month, day of the month, and time of the day;

b) sampling, at predetermined intervals, ambient noise, and at least one of ambient temperature, ambient humidity, and ambient brightness, and outputting at least two samples, respectively;

c) determining, after each new sampling, at least one tone parameter as a function of the at least two samples from step b) and the calendar information, respectively;

d) generating at least one tone signal as a function of the at least one tone parameter; and e) cancelling the tone signal from the ambient noise sample via subtracting the tone signal from the ambient noise sample;

wherein steps a) and b) have a repetitive relation, the method responding at said predetermined intervals to changes in the ambient environment according to the repetitive relation of steps a) and b).

41. A method as in claim 40, wherein:

the step c) of determining a tone parameter determines at least one of tone color, tone pitch, a play number assigned to a stored tone source, and tempo.

42. A method as in claim 40, wherein:

the step b) of sampling samples ambient noise, and samples at least one of ambient temperature, ambient humidity, and ambient brightness.

43. A method as in claim 40, further comprising:

generating at least one lamp control signal as a function of the at least two samples from step b) and the calendar information, for controlling at least one controllable light.

44. A method as in claim 40, further comprising:

storing sound source data corresponding to at least one of instrument sounds, human voice sounds, animal sounds, nature sounds, and artificial sounds; and the step of generating at least one tone signal generates as a function of both the sound source data and the at least one tone parameter.

45. A method as in claim 40, further comprising:

adding a sound effect to the at least one tone signal.

46. A method as in claim 40, wherein:

the sound effect is reverberation, the reverberation being adjusted as a function of the ambient noise sample.

47. A method as in claim 40, further comprising:

modulating an amplitude of the at least one tone signal as a function of the ambient noise sample.

48. A method as in claim 40, wherein:

samples taken include an ambient temperature sample and an ambient humidity sample.

49. A method as in claim 48, further comprising:

selecting the parameter of a play number assigned to a stored tone source as a function of the ambient temperature sample and the ambient humidity sample.

50. A method as in claim 44, wherein:

the at least one parameter is a play number assigned to a stored tone source; and one of the play numbers assigned to the stored tone sources is selected as a function of month information, day information, and time information.

51. A method as in claim 40, wherein: each predetermined interval is substantially one hour.

* * * * *